US011858765B2

(12) United States Patent
Oshida

(10) Patent No.: US 11,858,765 B2
(45) Date of Patent: Jan. 2, 2024

(54) SHEET CASSETTE

(71) Applicant: TOSHIBA TEC KABUSHIKI KAISHA, Tokyo (JP)

(72) Inventor: Katsuya Oshida, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 17/575,674

(22) Filed: Jan. 14, 2022

(65) Prior Publication Data

US 2023/0242356 A1 Aug. 3, 2023

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2405/114* (2013.01); *B65H 2511/10* (2013.01); *B65H 2511/12* (2013.01); *B65H 2511/22* (2013.01)

(58) Field of Classification Search
CPC .... B65H 1/04; B65H 9/101; B65H 2405/114; B65H 2405/1144; B65H 2405/1142; B65H 2405/11425; B65H 2405/141; B65H 2511/12
See application file for complete search history.

(56) References Cited

U.S. PATENT DOCUMENTS

2003/0116907 A1* 6/2003 Pearce ..... B65H 1/04 271/145
2006/0066705 A1* 3/2006 James ..... B65H 1/025 347/104
2012/0119434 A1 5/2012 Ueda et al.
2012/0224902 A1* 9/2012 Chiwata ..... B65H 31/24 400/578
2014/0246826 A1 9/2014 Kataoka
2020/0307275 A1* 10/2020 Yonemitsu ..... B65H 5/062
2021/0377408 A1* 12/2021 Yamamoto ..... B65H 1/04

FOREIGN PATENT DOCUMENTS

JP 2010-189176 9/2010
JP 2014-205568 10/2014

* cited by examiner

*Primary Examiner* — Prasad V Gokhale
(74) *Attorney, Agent, or Firm* — AMIN, TUROCY & WATSON, LLP

(57) ABSTRACT

A sheet cassette includes a sheet mounting unit, a first side guide, a second side guide, and a biasing unit. The first side guide comes into contact with the sheet at one end in a sheet width direction. The sheet width direction is a direction perpendicular to a sheet conveying direction in which the sheet is conveyed out from the sheet mounting unit. The sheet width direction is parallel to the mounting surface. The second side guide comes into contact with the sheet at the other end in the sheet width direction. The biasing unit has a biasing member. The biasing member biases at least the first side guide in a direction approaching the second side guide. The first side guide can rotate around a rotation shaft intersecting the mounting surface in a direction in which the first side guide approaches and separates from the second side guide.

20 Claims, 3 Drawing Sheets

SHEET CASSETTE

FIELD

Embodiments described herein relate generally to a sheet cassette, a sheet handling method, and an image forming apparatus.

BACKGROUND

An image processing apparatus has a sheet cassette. Sheets contained in the sheet cassette are conveyed out from the sheet cassette and supplied to an image processing unit of the image processing apparatus. Since a load in the sheet cassette may increase depending on a type of the sheet if the sheets are conveyed out, it is required to reduce a conveying load for the sheets.

DETAILED DESCRIPTION

In general, according to one embodiment, a sheet cassette includes a sheet mounting unit, a first side guide, a second side guide, and a biasing unit. The sheet mounting unit has amounting surface on which a plurality of sheets can be mounted. The first side guide can contact the sheet at one end in a sheet width direction. The sheet width direction is a direction perpendicular to a sheet conveying direction in which the sheet is conveyed out from the sheet mounting unit. The sheet width direction is parallel to the mounting surface. The second side guide can contact the sheet at the other end in the sheet width direction. The biasing unit has a biasing member. The biasing member biases at least the first side guide in a direction approaching the second side guide. The first side guide can rotate around a rotation shaft intersecting the mounting surface in a direction in which the first side guide approaches and separates from the second side guide. According to another embodiment, a sheet handling method involving mounting sheets on a surface of a sheet mounting component; bringing a first side guide into contact with a sheet at one end in a sheet width direction which is perpendicular to a sheet conveying direction in which the sheet is conveyed out from the sheet mounting component and is parallel to the mounting surface; bringing a second side guide into contact with the sheet at the other end in the sheet width direction; biasing at least the first side guide in a direction approaching the second side guide with a biasing component having a biasing member; and rotating the first side guide around a rotation shaft intersecting the mounting surface in a direction approaching but separated from the second side guide.

Hereinafter, the sheet cassette of the embodiment will be described with reference to the drawings.

Figure 1:
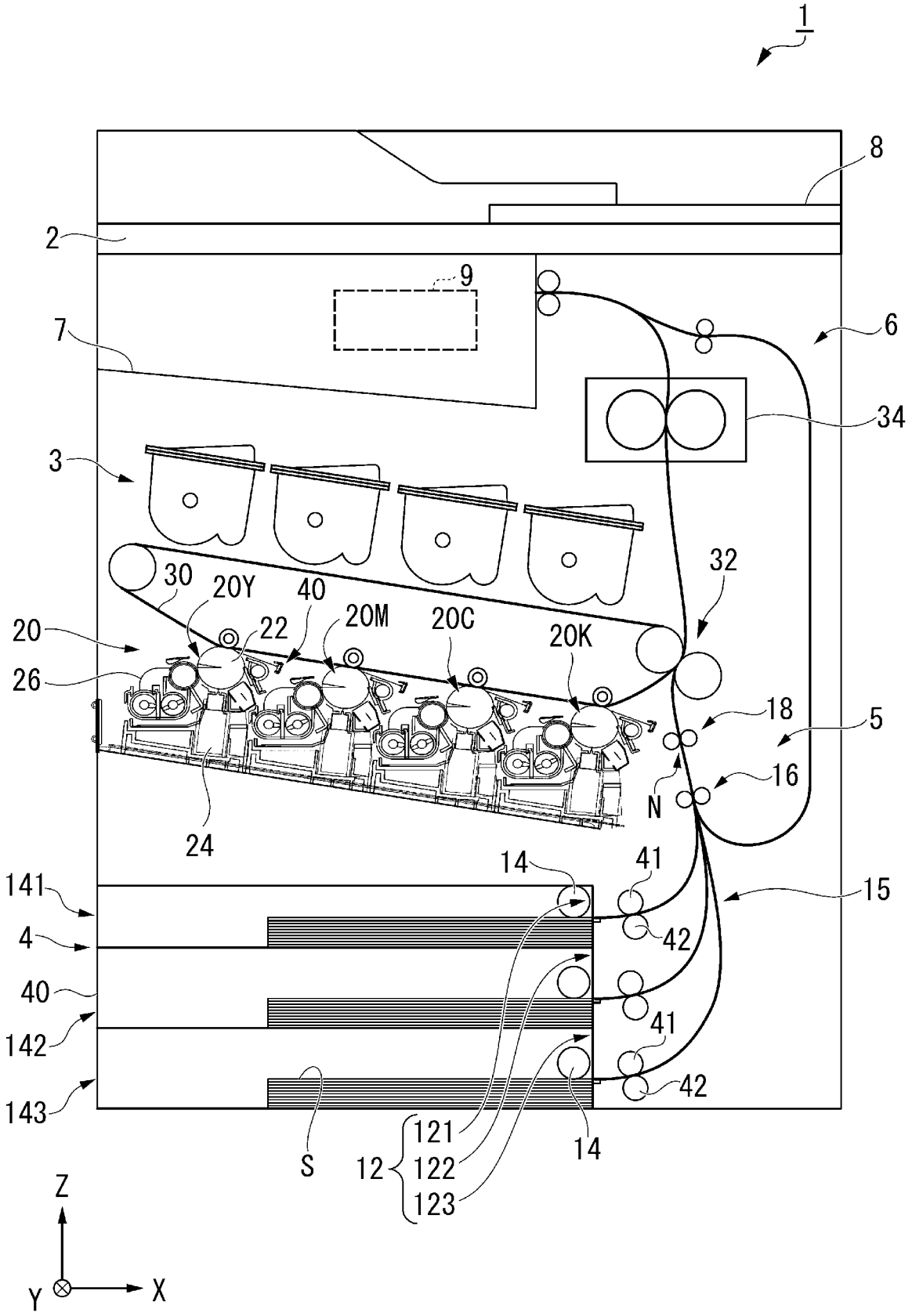
FIG. 1 is a schematic configuration diagram of an image processing apparatus.

FIG. 1 is a schematic configuration diagram of an image processing apparatus. As illustrated in FIG. 1, the image processing apparatus is an image forming apparatus 1. The image forming apparatus 1 forms an image on the sheet. The image forming apparatus 1 includes a scanner unit 2, an image forming unit 3, a sheet supply unit 4, a conveying unit 5, a reversing unit 6, a paper ejection tray 7, a control panel 8, and a control unit 9.

It is noted that the sheet on which the image is formed by the image forming apparatus 1 may be plain paper or may be thick paper. A thick paper is thicker than plain paper. For example, the thick paper is paper having a basis weight of more than 90 g/m 2. For example, the plain paper is paper having a basis weight of 35 to 90 g/m 2. The sheet has a rectangular shape.

The scanner unit 2 reads image information of a copy object based on brightness and darkness of light to generate an image signal. The scanner unit 2 outputs the generated image signal to the image forming unit 3.

The image forming unit 3 forms an image with a developer containing toner or the like based on the image signal received from the scanner unit 2 or the image signal received from the outside. This image is a "toner image". The image forming unit 3 transfers the toner image to the surface of the sheet S. The image forming unit 3 fixes the toner image on the sheet S. The image forming unit 3 performs an image forming process on the sheet S.

The sheet supply unit 4 supplies the sheets S one by one to the conveying unit 5 in response to the timing at which the image forming unit 3 forms the toner image. The sheet supply unit 4 includes a sheet cassette 40, a cassette storage unit 12, a pickup roller 14, a paper feed roller 41, and a separation roller 42. The sheet cassette 40 contains the sheets S having a predetermined size and type. The cassette storage unit 12 stores the sheet cassette 40. The sheet cassette 40 can be inserted and removed from the cassette storage unit 12. The pickup roller 14 takes out the sheets S one by one from the sheet cassette 40. The paper feed roller 41 supplies the taken-out sheets S to the conveying unit 5. The separation roller 42 faces the paper feed roller 41.

A sheet-shaped elastic body (guide member) may be provided between the pickup roller 14 and a nip formed by the paper feed roller 41 and the separation roller 42. The sheets S taken out from the pickup roller 14 come into contact with the elastic body. The elastic body is bent and deformed by the sheets S. The elastic body guides the sheets S to the nip of the paper feed roller 41 and the separation roller 42. The elastic body corrects an inclination of the sheet S. If the pickup roller 14 takes out the plurality of sheets S, the plurality of sheets S are separated by coming into contact with the elastic body.

The conveying unit 5 conveys the sheets S supplied from the sheet supply unit 4 to the image forming unit 3. The conveying unit 5 includes a convey roller 16 and a registration roller 18. The convey roller 16 conveys the sheets S supplied from the pickup roller 14 to the registration roller 18. The registration roller 18 adjusts a position of a tip of the sheet S in the conveying direction by bending the sheet S at the nip N. The registration roller 18 conveys the sheet S in response to the timing at which the image forming unit 3 transfers the toner image to the sheet S.

A configuration of the image forming unit 3 will be described.

The image forming unit 3 includes a plurality of electrophotographic process units 20, an exposure device 24, an intermediate transfer belt (transferred body) 30, a secondary transfer unit 32, and a fixing device 34. The electrophotographic process unit is "EPU".

The EPU 20 forms a toner image on a photoconductor drum 22 in response to the image signal from the scanner unit 2 or the outside. The EPU 20 includes a plurality of EPUs 20Y, 20M, and 20K. The EPUs 20Y, 20M, 20C, and 20K form toner images with yellow, magenta, cyan, and black toners, respectively. The EPU 20 includes the photoconductor drum 22 and a developing device 26.

The photoconductor drum 22 has a photoconductor layer of which charged state changes with exposure on an outer peripheral surface. The exposure device 24 exposes the photoconductor drum 22 to form an electrostatic latent image in response to the image signal on the photoconductor drum 22. The developing device 26 develops the electrostatic latent image on the photoconductor drum 22 with toner to form a toner image on the photoconductor drum 22.

The intermediate transfer belt 30 is an endless belt that moves in a circulating manner. At the primary transfer portion, which is a contact portion between the photoconductor drum 22 and the intermediate transfer belt 30, the toner image of the photoconductor drum 22 is primarily transferred to the intermediate transfer belt 30.

The secondary transfer unit 32 secondarily transfers the toner image primarily transferred to the intermediate transfer belt 30 to the surface of the sheet S.

The fixing device 34 applies heat and pressure to the sheet S to fix the toner image on the sheet S.

The reversing unit 6 reverses the sheet S ejected from the fixing device 34 and conveys the sheet S toward the registration roller 18 in order to form an image on the back surface of the sheet S.

The sheet S on which the image is formed and which is ejected in the image forming unit 3 is mounted on the paper ejection tray 7.

The control panel 8 displays information about the image forming apparatus 1 and receives input of information. The control panel 8 receives the input of information about the size of the sheet S contained in the sheet cassette 40. The information about the size of the sheet S is "size information". The control panel 8 has a display, a touch panel, various hard keys, and the like.

The sheet cassette 40 will be described in detail.

Figure 2:
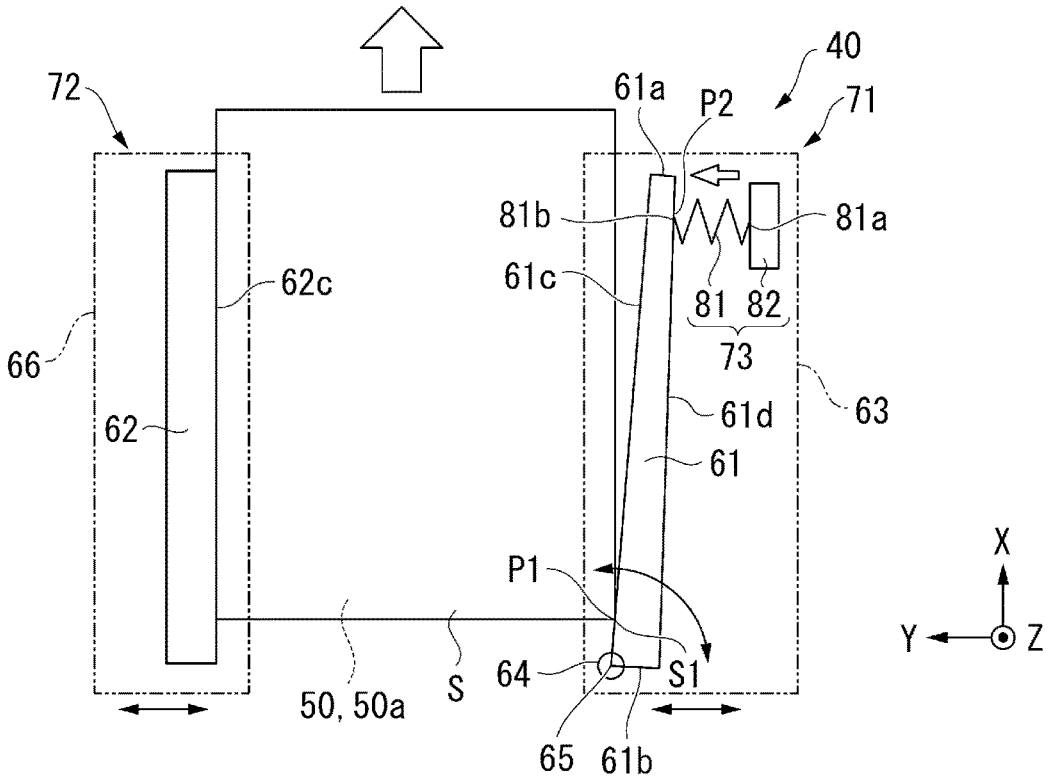
FIG. 2 is a configuration diagram of a sheet cassette of a first embodiment.

FIG. 2 is a configuration diagram of the sheet cassette of a first embodiment. As illustrated in FIG. 2, the sheet cassette 40 includes a sheet mounting unit 50, a first side guide unit 71, a second side guide unit 72, and a biasing unit 73.

The X, Y, and Z directions of the Cartesian coordinate system are defined as follows. The X direction is a direction in which the sheet S mounted on the sheet mounting unit 50 is conveyed out from the sheet mounting unit 50. The X direction is the "sheet conveying direction". The +X direction is on a downstream side in the sheet conveying direction. The −X direction is on an upstream side in the sheet conveying direction. The Z direction is the thickness direction of the sheet S mounted on the sheet mounting unit 50. The Z direction is perpendicular to the X direction. The +Z direction is a direction from the lower layer to the upper layer of the plurality of sheets S mounted on the sheet mounting unit 50. The Y direction is perpendicular to the X and Z directions. The Y direction is parallel to a mounting surface 50*a* of the sheet mounting unit 50. The Y direction is a "sheet width direction".

The sheets S having a plurality of sizes can be mounted on the sheet mounting unit 50. The sheet S is mounted on the mounting surface 50*a* of the sheet mounting unit 50.

The first side guide unit 71 includes a first base plate 63 and a first side guide 61. The first base plate 63 has a flat plate shape parallel to an XY plane. The first side guide 61 has a plate shape that rises from the first base plate 63 in the +Z direction.

The end of the first side guide 61 on the downstream side in the sheet conveying direction is a first end 61*a*. The end of the first side guide 61 on the upstream side in the sheet conveying direction is a second end 61*b*. The side surface of the first side guide 61 facing the second side guide 62 is an inner side surface 61*c*. The surface of the first side guide 61 opposite to the inner side surface 61*c* is an outer side surface 61*d*. The inner side surface 61*c* of the first side guide 61 can come into contact with the sheet S at the end (one end) of the sheet S in the −Y direction. The inner side surface 61*c* of the first side guide 61 is perpendicular to the XY plane.

The first side guide 61 is supported by the first base plate 63 in a rotation support portion 64. The rotation support portion 64 is provided at the second end 61*b* of the first side guide 61. The rotation support portion 64 has a rotation shaft 65. The rotation shaft 65 intersects the mounting surface 50*a*. Specifically, the rotation shaft 65 is perpendicular to the mounting surface 50*a*. The first side guide 61 can rotate around the rotation shaft 65 in the rotation support portion 64. The first side guide 61 can rotate in a direction in which the first end 61*a* approaches and separates from the second side guide 62. For example, a separation distance of the rotation shaft 65 from the second side guide 62 in the Y direction is smaller than a width of the sheet S.

The first side guide 61 is located near the end of the sheet mounting unit 50 in the −Y direction.

The biasing unit 73 includes a biasing member 81 and a pressure receiving member 82. For example, the biasing member 81 is a stretchable spring. For example, the biasing member 81 is a coil spring. One end of the biasing member 81 in an expansion and contraction direction is a base end 81*a*. The base end 81*a* of the biasing member 81 can come into contact with the pressure receiving member 82. The other end of the biasing member 81 in the expansion and contraction direction is a tip 81*b*. The tip 81*b* of the biasing member 81 can come into contact with the outer side surface 61*d* of the first side guide 61. The biasing member 81 exerts a reaction force on the pressure receiving member 82 to bias the first side guide 61 in the direction approaching the second side guide 62. The tip 81*b* of the biasing member 81 can come into contact with the first side guide 61 at a position near the first end 61*a* (a biasing position P2). The position (the biasing position P2) where the tip 81*b* of the biasing member 81 comes into contact with the first side guide 61 is a position on the tip side rather than the rotation shaft 65 in the first side guide 61.

The pressure receiving member 82 has a plate shape that rises from the first base plate 63 in the +Z direction. The pressure receiving member 82 is fixed to the first base plate 63. For example, the pressure receiving member 82 has a flat plate shape parallel to an XZ plane.

The first side guide unit 71 can move in the Y direction. For this reason, the position of the first side guide 61 in the Y direction can be adjusted according to the size of the sheet S.

The second side guide unit 72 includes a second base plate 66 and a second side guide 62. The second base plate 66 has a flat plate shape parallel to the XY plane. The second side guide 62 has a plate shape that rises from the second base plate 66 in the +Z direction.

The side surface of the second side guide 62 facing the first side guide 61 is an inner side surface 62*c*. The inner side surface 62*c* of the second side guide 62 can come into contact with the sheet S at the end (the other end) of the sheet S in the +Y direction. The inner side surface 62*c* of the second side guide 62 is parallel to the XZ plane.

The second side guide 62 is separated from the first side guide 61 in the +Y direction. The second side guide 62 is located near the end of the sheet mounting unit 50 in the +Y direction. Unlike the first side guide 61, the posture of the second side guide 62 does not change. The second side guide 62 always maintains the posture in which the inner side surface 62*c* is parallel to the XZ plane.

The second side guide unit 72 can move in the Y direction. For this reason, the position of the second side guide 62 in the Y direction can be adjusted according to the size of the sheet S.

A pinion gear may be provided between the first side guide unit 71 and the second side guide unit 72. A rack extending from the side guide units 71 and 72 is engaged with the pinion gear. The side guide units 71 and 72 can move symmetrically to a plane in the Y direction with the XZ plane as the plane of symmetry.

The operations of the sheet cassette 40 will be described.

A user of the image forming apparatus 1 mounts the sheet S on the mounting surface 50*a* of the sheet mounting unit 50. The user moves one or both of the first side guide unit 71 and the second side guide unit 72 in the Y direction and allows the first side guide 61 and the second side guide 62 to come into contact with both ends of the sheet S in the Y direction, respectively.

The first side guide 61 comes into contact with the sheet S at a contact position P1 of the inner side surface 61*c*. The contact position P1 is on the downstream side of the rotation shaft 65 in the sheet conveying direction. The contact position P1 is closer to the first end 61*a* than the rotation shaft 65. The first side guide 61 comes into contact with a corner portion S1 of the sheet S. The corner portion S1 is one of the two corner portions of the sheet S in the −X direction side. The inner side surface 61*c* of the first side guide 61 is inclined with respect to the XZ plane. The inner side surface 61*c* of the first side guide 61 is gradually inclined in a direction away from the second side guide 62 toward the +X direction.

The tip 81*b* of the biasing member 81 comes into contact with the first side guide 61 at the biasing position P2. The biasing member 81 presses the first side guide 61 in a direction approaching the second side guide 62. The biasing position P2 is on the downstream side from the contact position P1 in the sheet conveying direction. The biasing position P2 is closer to the first end 61*a* than the contact position P1. The biasing unit 73 biases the first side guide 61 in the direction approaching the second side guide 62 at the biasing position P2.

As illustrated in FIG. 1, the user inputs the size information of the sheet S contained in the sheet cassette 40 to the control panel 8. The control unit 9 stores the size information of the sheet S contained in each sheet cassette 40. The user inputs an image formation (printing) command to the control panel 8. The control unit 9 supplies the sheets S from the sheet cassette 40 containing the sheets S having a required size and executes image formation.

The image forming apparatus 1 includes a plurality of cassette storage units 121, 122, and 123. The plurality of cassette storage units 121, 122, and 123 are the first cassette storage unit 121, the second cassette storage unit 122, and the third cassette storage unit 123, respectively. The first sheet cassette 141 is stored in the first cassette storage unit 121. The second sheet cassette 142 is stored in the second cassette storage unit 122. The third sheet cassette 143 is stored in the third cassette storage unit 123. The sheet cassette 40 of the embodiment is at least one of the first sheet cassette 141, the second sheet cassette 142, and the third sheet cassette 143.

The sheets S are ejected from the sheet cassettes 141, 142, and 143 in the +X direction and reach the convey roller 16.

As illustrated in FIG. 2, the sheet cassette 40 of the embodiment has the first side guide 61. The first side guide 61 can rotate around the rotation shaft 65 in a direction in which the first side guide 61 approaches and separates from the second side guide 62. Since the first side guide 61 can take an inclined posture, the first side guide 61 can come into contact with the corner portion S1 of the sheet S. The first side guide 61 can suppress misalignment of the sheet S in the Y direction by coming into contact with the corner portion S1 of the sheet S. Since the contact area between the first side guide 61 and the sheet S is small in the sheet cassette 40, friction when conveying the sheet S can be reduced and a conveying load can be reduced. The sheet cassette 40 can easily convey the sheet S even if the sheet S is thick paper.

Since the biasing unit 73 biases the first side guide 61 in the direction approaching the second side guide 62 at a position (biasing position P2) on the downstream side from the rotation shaft 65 in the sheet conveying direction, the biasing unit 73 can efficiently exert a biasing force on the first side guide 61.

Since the positions of the first side guide 61 and the second side guide 62 can be adjusted in the Y direction, the sheet cassette 40 can cope with the sheets S having a plurality of sizes.

Since the rotation shaft 65 is provided at the second end 61*b* of the first side guide 61, in the inner side surface 61*c* of the first side guide 61, a range that covers almost the entire length can function as a contact surface with respect to the sheet S. As compared with a case where the rotation shaft 65 is at an intermediate position of the first side guide 61, the sheet cassette 40 can reduce the size of the first side guide 61.

The first side guide 61 comes into contact with the sheet S at the contact position P1 on the downstream side from the rotation shaft 65 in the sheet conveying direction. The biasing unit 73 biases the first side guide 61 at the biasing position P2 on the downstream side from the contact position P1 in the sheet conveying direction. The first side guide 61 can efficiently apply the biasing force obtained at the biasing position P2 to the sheet S at the contact position P1.

Since the first side guide 61 comes into contact with the sheet S in a posture of being inclined in a direction away from the second side guide 62 toward the +X direction, the first side guide 61 comes into contact with the corner portion S1 of the sheet S. Since the contact area between the first side guide 61 and the sheet S is small, friction when conveying the sheet S can be reduced and the conveying load can be reduced.

The first side guide 61 is supported by the first base plate 63 in the rotation support portion 64. The pressure receiving member 82 is fixed to the first base plate 63. Since the first side guide 61 and the pressure receiving member 82 are supported by the common first base plate 63, the relative position between the base end 81*a* of the biasing member 81 and the rotation shaft 65 is constant. Since the relative position between the base end 81*a* and the rotation shaft 65 is constant, the biasing force of the biasing unit 73 can be stabilized regardless of the position of the first side guide unit 71 in the Y direction.

In the sheet cassette 40, the positions of both the first side guide unit 71 and the second side guide unit 72 can be adjusted in the Y direction, but the configuration of the side guide units is not limited to the embodiment. The position of at least one of the first side guide unit and the second side guide unit may be able to be adjusted in the Y direction.

Figure 3:
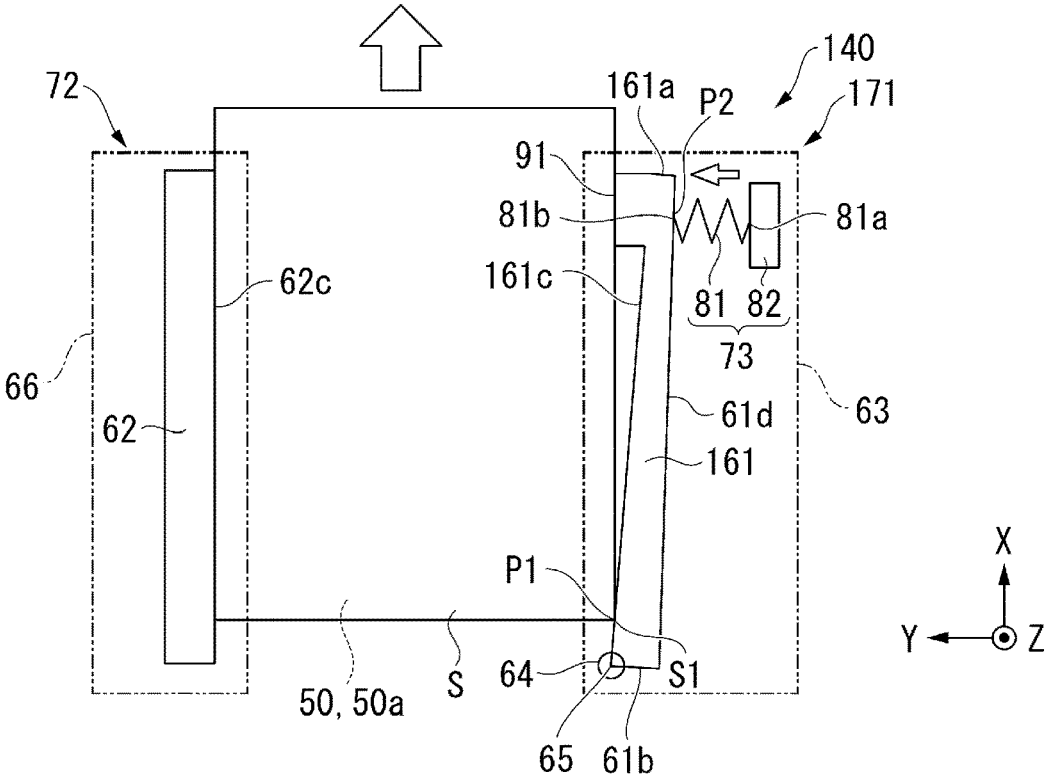
FIG. 3 is a configuration diagram of a sheet cassette of a second embodiment.

FIG. 3 is a configuration diagram of the sheet cassette of a second embodiment. The common components with the first embodiment are denoted by the same reference numerals, and the description thereof will be omitted.

As illustrated in FIG. 3, a sheet cassette 140 includes a sheet mounting unit 50, a first side guide unit 171 and a second side guide unit 72, and a biasing unit 73.

The sheet cassette 140 is different from the sheet cassette 40 of the first embodiment (refer to FIG. 2) in that the sheet cassette 140 includes a first side guide 161 instead of the first side guide 61.

A contact protrusion 91 is formed on an inner side surface 161*c* of the first side guide 161. The contact protrusion 91 protrudes from the inner side surface 161*c* in a direction approaching the second side guide 62. The shape of the contact protrusion 91 is not particularly limited. For example, the contact protrusion 91 may be rectangular parallelepiped, hemispherical, prismatic, conical, or the like. The contact protrusion 91 can come into contact with the end of the sheet S in the −Y direction. The contact protrusion 91 is located at a position on the +X direction side of the rotation shaft 65. The contact protrusion 91 is located on the +X direction side from the contact position P1. For example, the contact protrusion 91 is formed at a position including a first end 161*a* of the first side guide 161. For example, the first side guide 161 comes into contact with the sheet S at the contact position P1 and the contact protrusion 91.

In the sheet cassette 140, since the contact protrusion 91 that can come into contact with the sheet S is formed in the first side guide 161, it is possible to suppress the misalignment of the sheet S in the Y direction. Since the contact area between the first side guide 161 and the sheet S does not become too large, the conveying load when conveying the sheet S can be reduced.

Figure 4:
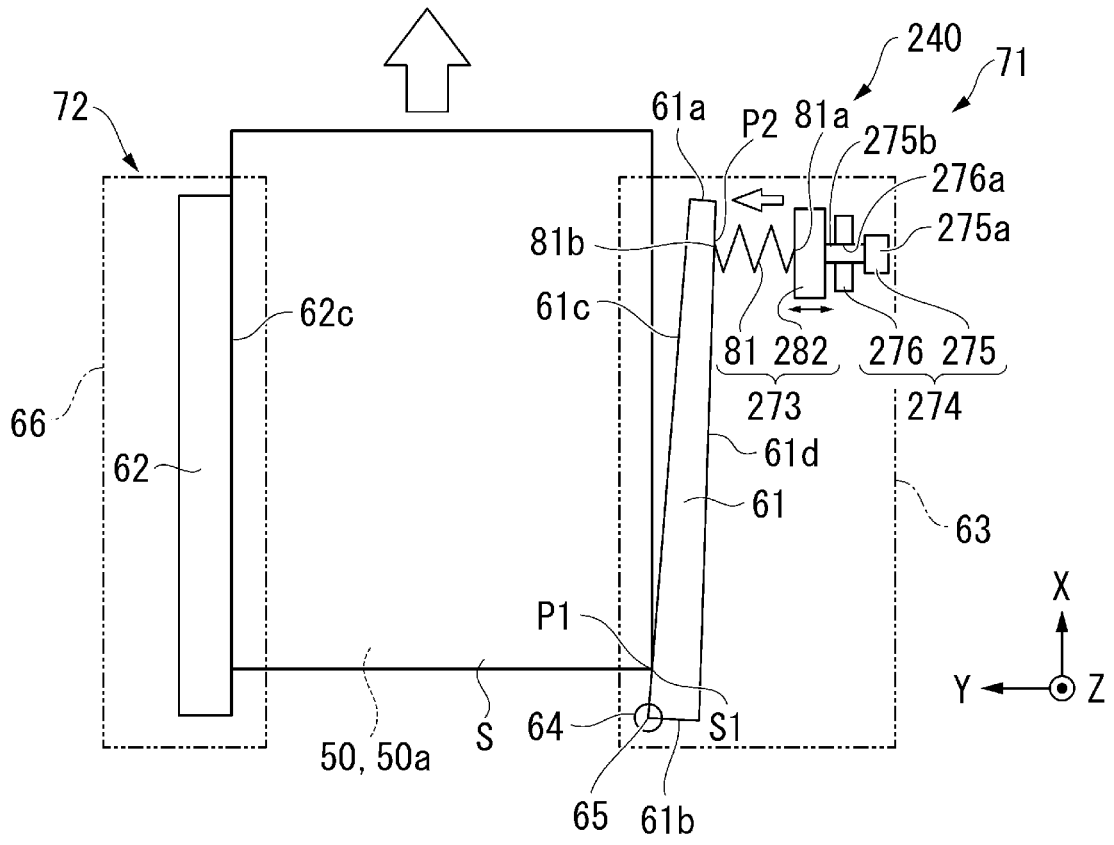
FIG. 4 is a configuration diagram of a sheet cassette of a third embodiment.

FIG. 4 is a configuration diagram of the sheet cassette of a third embodiment. The common components with the first embodiment are denoted by the same reference numerals, and the description thereof will be omitted.

As illustrated in FIG. 4, a sheet cassette 240 includes a sheet mounting unit 50, a first side guide unit 71, a second side guide unit 72, a biasing unit 273, and an adjusting mechanism 274.

The sheet cassette 240 is different from the sheet cassette 40 of the first embodiment (refer to FIG. 2) in that the sheet cassette 240 includes the biasing unit 273 instead of the biasing unit 73 and in that the sheet cassette 240 includes the adjusting mechanism 274.

The pressure receiving member 282 of the biasing unit 273 can move in the Y direction.

The adjusting mechanism 274 adjusts the biasing force of the biasing member 81. The adjusting mechanism 274 includes an adjusting member 275 and a support member 276. The support member 276 has a plate shape along the XY plane. The support member 276 has an insertion hole 276*a* penetrating in the thickness direction. A female screw is formed on an inner peripheral surface of the insertion hole 276*a*.

The adjusting member 275 has a head portion 275*a* and a screw shaft 275*b*. The screw shaft 275*b* extends from the head portion 275*a*. A male screw of the screw shaft 275*b* is screwed into the female screw of the insertion hole 276*a*. The adjusting member 275 can move forward and backward in a direction in which the adjusting member 275 approaches and separates from the pressure receiving member 282 in a state where the screw shaft 275*b* is inserted into the insertion hole 276*a*. The adjusting member 275 comes into contact with the pressure receiving member 282 and can adjust the position of the pressure receiving member 282 in the Y direction. Since the adjusting member 275 can adjust the position of the base end 81*a* of the biasing member 81 in the Y direction via the pressure receiving member 282, the adjusting member 275 can adjust the biasing force of the biasing member 81.

Since the sheet cassette 240 can adjust the biasing force of the biasing unit 273, the sheet cassette 240 can optimize the conveying load of when conveying the sheet S.

According to at least one of the embodiments described above, the first side guide 61 can rotate around the rotation shaft 65 in a direction in which the first side guide 61 approaches and separates from the second side guide 62. The first side guide 61 can suppress the misalignment of the sheet S in the Y direction by coming into contact with the corner portion S1 of the sheet S. Since the contact area between the first side guide 61 and the sheet S is small, friction when conveying the sheet S can be reduced and the conveying load can be reduced.

While certain embodiments have been described, these embodiments have been presented by way of example only, and are not intended to limit the scope of the inventions. Indeed, the novel embodiments described herein may be embodied in a variety of other forms: furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet cassette, comprising:

a sheet mounting component having a mounting surface on which a plurality of sheets are mountable;

a first side guide configured to come into contact with a sheet at one end in a sheet width direction which is perpendicular to a sheet conveying direction in which the sheet is conveyed out from the sheet mounting component and is parallel to the mounting surface;

a second side guide configured to come into contact with the sheet at the other end in the sheet width direction; and a biasing component having a biasing member that biases at least the first side guide in a direction approaching the second side guide, wherein the first side guide is further configured to rotate around a rotation shaft intersecting a plane of the mounting surface in a direction approaching the second side guide and separated from the second side guide.

2. The sheet cassette according to claim 1, wherein the first side guide rotates in a direction in which a first end on a downstream side in the sheet conveying direction approaching the second side guide and separated from the second side guide.

3. The sheet cassette according to claim 2, wherein the biasing component biases the first side guide in a direction approaching the second side guide at a position on the downstream side from the rotation shaft in the sheet conveying direction.

4. The sheet cassette according to claim 1, wherein at least one of the first side guide and the second side guide adjusts a position in the sheet width direction.

5. The sheet cassette according to claim 1, wherein the rotation shaft is provided at a second end of the first side guide on an upstream side in the sheet conveying direction.

6. The sheet cassette according to claim 1, wherein the first side guide comes into contact with the sheet at a contact position on a downstream side from the rotation shaft in the sheet conveying direction, and the biasing component biases the first side guide in a direction approaching the second side guide at a biasing position on the downstream side from the contact position in the sheet conveying direction.

7. The sheet cassette according to claim 1, wherein the first side guide comes into contact with the sheet in an inclined state in a direction away from the second side guide toward a downstream side in the sheet conveying direction.

8. The sheet cassette according to claim 1, wherein the biasing member is a stretchable spring that presses the first side guide at a tip in a direction approaching the second side guide, and a relative position between a base end of the biasing member opposite to the tip and the rotation shaft is constant.

9. The sheet cassette according to claim 1, wherein a contact protruding portion that comes into contact with the sheet is formed in the first side guide, and the contact protruding portion protrudes in a direction approaching the second side guide on a downstream side from the rotation shaft in the sheet conveying direction.

10. The sheet cassette according to claim 1, further comprising an adjusting mechanism that adjusts a biasing force of the biasing component.

11. A sheet handling method, comprising:

mounting sheets on a surface of a sheet mounting component;

bringing a first side guide into contact with a sheet at one end in a sheet width direction which is perpendicular to a sheet conveying direction in which the sheet is conveyed out from the sheet mounting component and is parallel to the mounting surface;

bringing a second side guide into contact with the sheet at the other end in the sheet width direction;

biasing at least the first side guide in a direction approaching the second side guide with a biasing component having a biasing member; and rotating the first side guide around a rotation shaft intersecting a plane of the mounting surface in a direction approaching the second side guide and separated from the second side guide.

12. The sheet handling method according to claim 11, further comprising:

rotating the first side guide in a direction in which a first end on a downstream side in the sheet conveying direction approaching the second side guide and separated from the second side guide.

13. The sheet handling method according to claim 12, further comprising:

biasing the first side guide in a direction approaching the second side guide at a position on the downstream side from the rotation shaft in the sheet conveying direction with the biasing component.

14. The sheet handling method according to claim 11, further comprising:

adjusting a position in the sheet width direction with at least one of the first side guide and the second side guide.

15. The sheet handling method according to claim 11, further comprising:

bringing the first side guide into contact with the sheet at a contact position on a downstream side from the rotation shaft in the sheet conveying direction, and biasing the first side guide in a direction approaching the second side guide at a biasing position on the downstream side from the contact position in the sheet conveying direction with the biasing component.

16. The sheet handling method according to claim 11, further comprising:

bringing the first side guide into contact with the sheet in an inclined state in a direction away from the second side guide toward a downstream side in the sheet conveying direction.

17. The sheet handling method according to claim 11, further comprising:

pressing a stretchable spring against the first side guide at a tip in a direction approaching the second side guide, and a relative position between a base end of the stretchable spring opposite to the tip and the rotation shaft is constant.

18. The sheet handling method according to claim 11, further comprising:

adjusting a biasing force of the biasing component.

19. An image forming apparatus, comprising:

an image forming component; and a sheet cassette adjacent the image forming component, comprising:

a sheet mounting component having a mounting surface on which a plurality of sheets are mountable;

a first side guide configured to come into contact with a sheet at one end in a sheet width direction which is perpendicular to a sheet conveying direction in which the sheet is conveyed out from the sheet mounting component to the image forming component and is parallel to the mounting surface;

a second side guide configured to come into contact with the sheet at the other end in the sheet width direction; and a biasing component having a biasing member that biases at least the first side guide in a direction approaching the second side guide, wherein the first side guide is further configured to rotate around a rotation shaft intersecting a plane of the mounting surface in a direction approaching the second side guide and separated from the second side guide.

20. The image forming apparatus according to claim 19, wherein the first side guide rotates in a direction in which a first end on a downstream side in the sheet conveying direction approaching the second side guide and separated from the second side guide.

* * * * *